US007322572B1

(12) United States Patent
Yang

(10) Patent No.: US 7,322,572 B1
(45) Date of Patent: Jan. 29, 2008

(54) SPRING-BIASED MECHANISM FOR QUICKLY FASTENING SLIDE BAR AND FIXED JAW CARRIER OF VISE

(75) Inventor: Ching-chen Yang, Taichung (TW)

(73) Assignee: Great Clamp Company, Taichung (TW)

( * ) Notice: Subject to any disclaimer, the term of this patent is extended or adjusted under 35 U.S.C. 154(b) by 0 days.

(21) Appl. No.: 11/687,670

(22) Filed: Mar. 19, 2007

(51) Int. Cl.
*B25B 5/02* (2006.01)

(52) U.S. Cl. ..... 269/6; 269/3

(58) Field of Classification Search ..... 403/109.3, 403/109.6, 109.7, 109.8, 432, 324, 325; 280/515; 24/453; 70/258; 411/345; 81/60; 269/6, 269/69, 70, 208, 147–149
See application file for complete search history.

(56) References Cited

U.S. PATENT DOCUMENTS 4,243,342 A * 1/1981 Marto ..... 403/324
7,172,183 B1 * 2/2007 Yang ..... 269/6

* cited by examiner

*Primary Examiner*—Robert C. Watson

(57) ABSTRACT

A mechanism includes a first push button at one side and a spring-biased second push button at the other side such that pressing the first push button will lock a slide bar of a vise and a fixed jaw carrier thereof by inserting a first pin of the first push button into one positioning hole of the slide bar, pressing the second push button to insert a second pin thereof into one positioning hole by pushing the first pin out of one positioning hole with the spring being compressed, and releasing the second push button will cause the spring to expand to push the second push button outwardly and push the second pin out of one positioning hole for unlocking the slide bar.

2 Claims, 5 Drawing Sheets

SPRING-BIASED MECHANISM FOR QUICKLY FASTENING SLIDE BAR AND FIXED JAW CARRIER OF VISE

BACKGROUND OF THE INVENTION

1. Field of Invention

The invention relates to vises and more particularly to a spring-biased mechanism for quickly fastening a slide bar and a fixed jaw carrier of a vise and unfastening same.

2. Description of Related Art

Vises are well known devices. A typical vise is shown in FIGS. 1, 2 and 3. In one operating position (see FIG. 2), a work piece (not shown) is placed between a fixed jaw carrier 1 fixedly secured to one end of a slide bar 3 and a movable jaw carrier 2 slidably put on the slide bar 3. Next, push the movable jaw carrier 2 toward the fixed jaw carrier 1 to firmly hold the work piece therebetween. A second positioning hole 3*b* is provided at the other end of the slide bar 3.

In the other operating position (see FIG. 3), the fixed jaw carrier 1 and the movable jaw carrier 2 are placed between another work piece (not shown). Next, push the movable jaw carrier 2 away from the fixed jaw carrier 1 to firmly hold the work piece by urging both the fixed jaw carrier 1 and the movable jaw carrier 2 outwardly against the work piece. A first positioning hole 3*a* is provided at one end of the slide bar 3.

As shown in FIG. 1, the fixed jaw carrier 1 comprises a transverse first hole 1*a* and a longitudinal second hole 1*b* in communication with the first hole 1*a* at a center of a base of the fixed jaw carrier 1. The first hole 1*a* is aligned with the first positioning hole 3*a* or the second positioning hole 3*b*. The second hole 1*b* is dimensioned and shaped to put on the slide bar 3. For fastening the fixed jaw carrier 1 and the slide bar 3 together, a bolt 6 is driven through the first hole 1*a* and the first positioning hole 3*a* (or the second positioning hole 3*b*). Next, secure a nut 5 to threads 6*a* at the open end of the bolt 6 by threading.

However, the well known mechanism for fastening the slide bar 3 and the fixed jaw carrier 1 and unfastening same suffered from a couple of disadvantages. For example, the fastening operation is relatively slow due to threading. Further, its unfastening operation is relatively slow also due to threading.

Still, there have been numerous suggestions in prior patents for vise. For example, U.S. Pat. No. 7,036,807 discloses a quick release vise. Thus, continuing improvements in the exploitation of vise are constantly being sought.

SUMMARY OF THE INVENTION

It is therefore one object of the invention to provide a mechanism comprising a first push button at one side and a spring-biased second push button at the other side such that pressing the first push button will lock a slide bar of a vise and a fixed jaw carrier of the vise, and pressing and releasing the second push button will unlock same.

The above and other objects, features and advantages of the invention will become apparent from the following detailed description taken with the accompanying drawings.

DETAILED DESCRIPTION OF THE INVENTION

Figure 1:
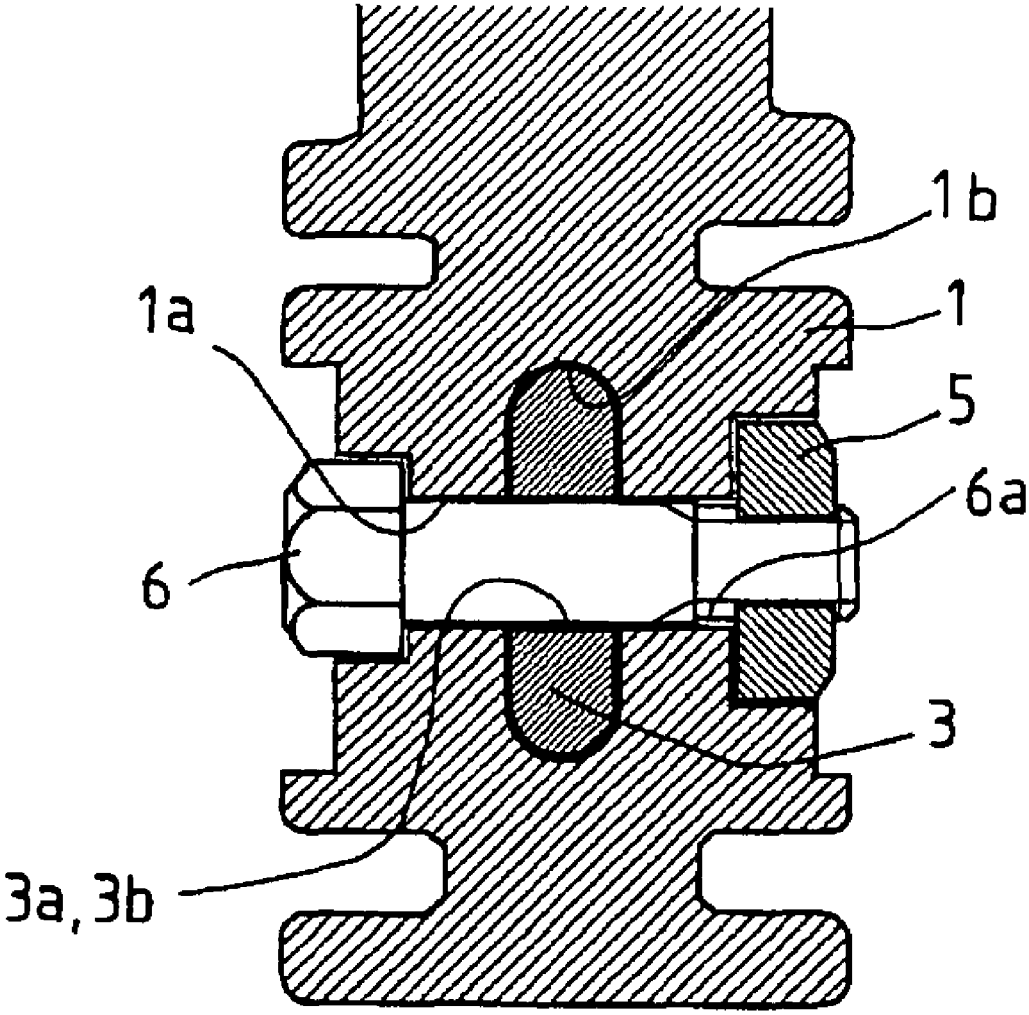
FIG. 1 PRIOR ART
FIG. 1 is a sectional view of the fixed jaw carrier and the slide bar of a conventional vise being fastened together by means of a bolt and nut combination.
Figure 2:
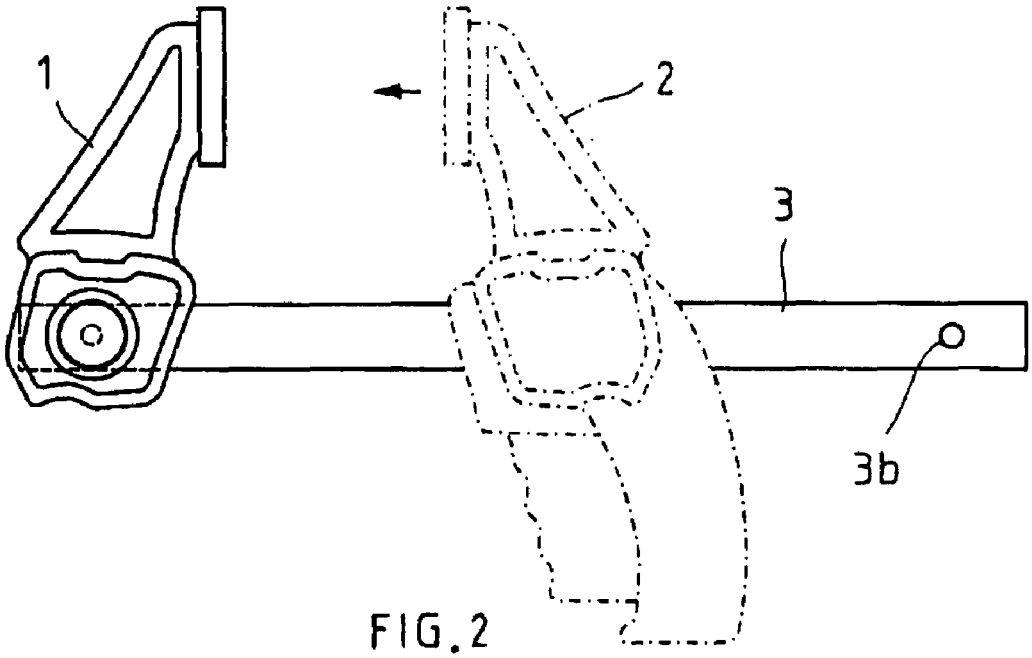
FIG. 2 PRIOR ART
FIG. 2 is a side view of the vise of FIG. 1 showing one operating position thereof.
Figure 3:
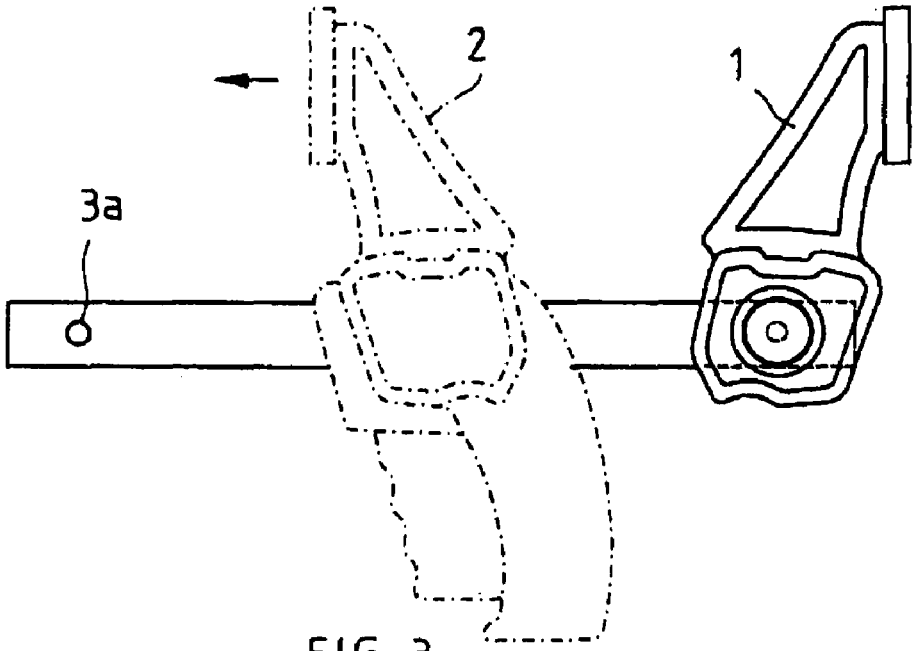
FIG. 3 PRIOR ART
FIG. 3 is a side view of the vise of FIG. 1 showing the other operating position thereof.
Figure 4:
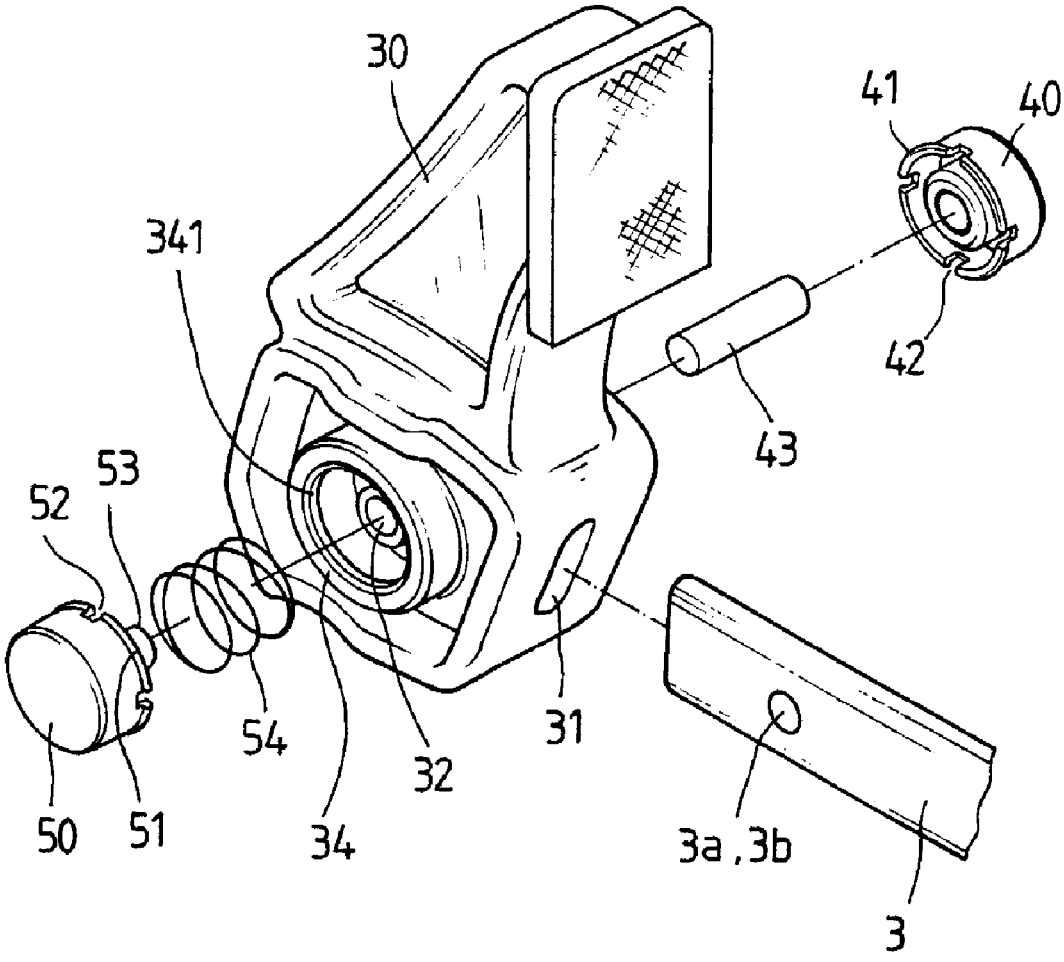
FIG. 4 is an exploded view of a portion of a vise according to the invention.
Figure 5:
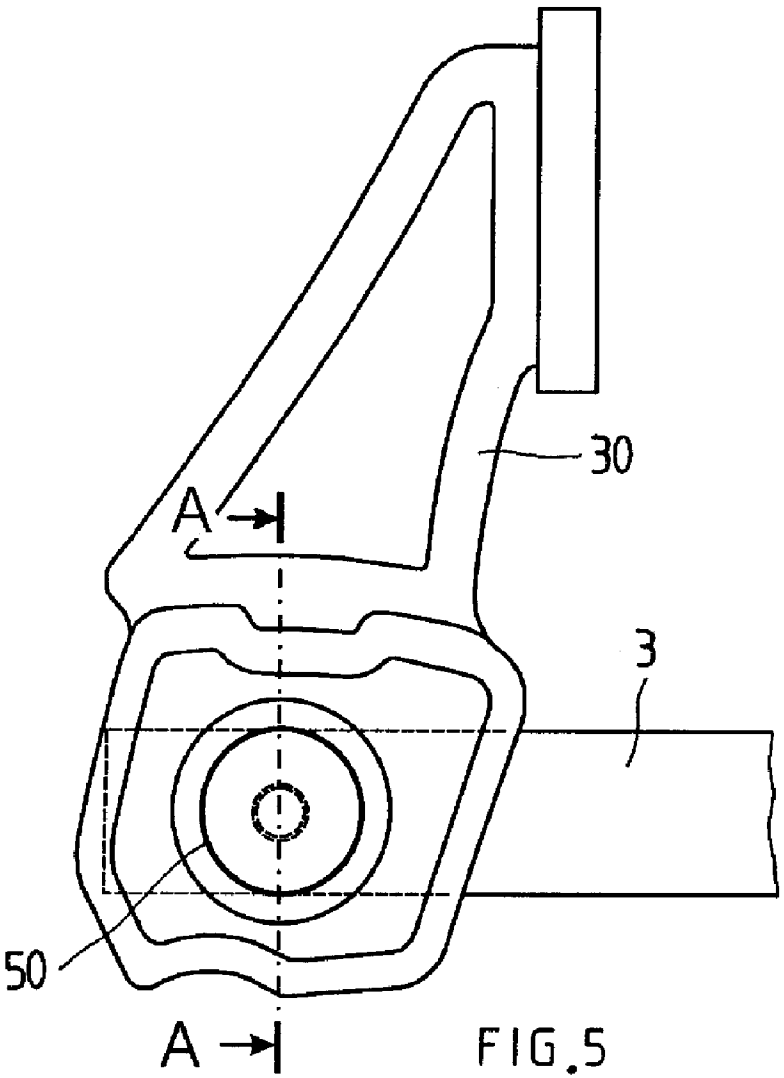
FIG. 5 is a side view of the assembled vise of FIG. 4.
Figure 5A:
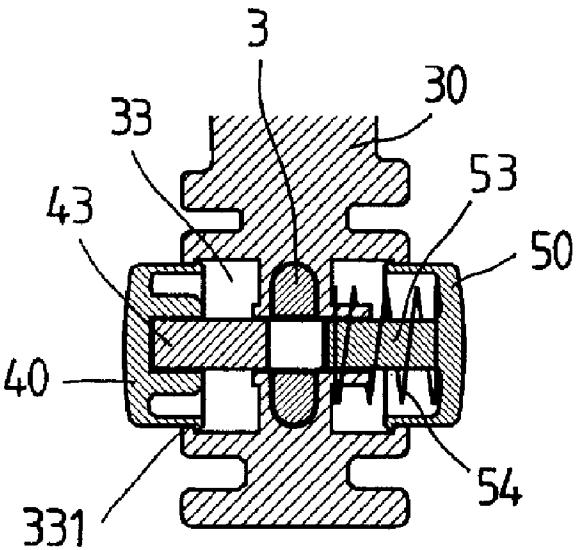
FIG. 5A is a sectional view taken along line A-A of FIG. 5 where the slide bar is unlocked.

Referring to FIGS. 4, 5, and 5A, a portion of a vise in accordance with a preferred embodiment of the invention is shown. The vise comprises a fixed jaw carrier 30, a slide bar 3 having a first positioning hole 3*a* at one end and a second positioning hole 3*b* at the other end, a movable jaw carrier (not shown) put on the slide bar 3, a first push button 40, and a second push button 50. The fixed jaw carrier 30, the first push button 40, and the second push button 50 as the subject of the invention are discussed in detailed below.

The fixed jaw carrier 30 comprises a longitudinal first hole 31 and a transverse second hole 32 raised at both sides and in communication with the first hole 31 at a center of a base of the fixed jaw carrier 30. A first space 33 is defined between the second hole 32 and a first annular flange (not numbered) concentric with the second hole 32 at the other side of the fixed jaw carrier 30. The first flange has an inwardly extending rim 341 at an open end. Also, a second space 34 is defined between the second hole 32 and a second annular flange (not numbered) concentric with the second hole 32 at one side of the fixed jaw carrier 30. The second flange has an inwardly extending rim 331 at an open end.

The first hole 31 is dimensioned and shaped to put on the slide bar 3. The second hole 32 is aligned with the first positioning hole 3*a* or the second positioning hole 3*b* for positioning.

The first push button 40 comprises a cylindrical head (not numbered), four spaced outwardly extending curved members 41 provided along an inner end, four spaced recesses 42 each provided between two adjacent curved members 41, and a cylindrical pin 43 having one end slidably inserted into the second hole 32 and the other end fixedly fastened in a central bore (not numbered) of the first push button 40. The first push button 40 is slidably secured onto an opening of the first space 33 by frictionally engaging the curved members 41 with the rim 331. Also, the engagement of the curved members 41 with the rim 331 prevents the first push button 40 from separating from the fixed jaw carrier 30 inadvertently.

The second push button 50 comprises a cylindrical head (not numbered), four spaced outwardly extending curved members 51 provided along an inner end, four spaced recesses 52 each provided between two adjacent curved members 51, a cylindrical pin 53 extending from a center of the second push button 50 into the second hole 32 to be adapted to slide therein, and a helical spring 54 put on both the pin 53 and a boss of the second hole 32 and anchored between an inner wall of the second push button 50 and a bottom of the second space 34. The second push button 50 is slidably secured onto an opening of the second space 34 by frictionally engaging the curved members 51 with the rim 341. Also, the engagement of the curved members 51 with the rim 341 prevents the second push button 50 from separating from the fixed jaw carrier 30 inadvertently.

As shown in FIG. 5A, both the pins 43 and 53 clear the first positioning hole 3*a* or the second positioning hole 3*b* in an unlocked state of the slide bar 3.

Figure 8:
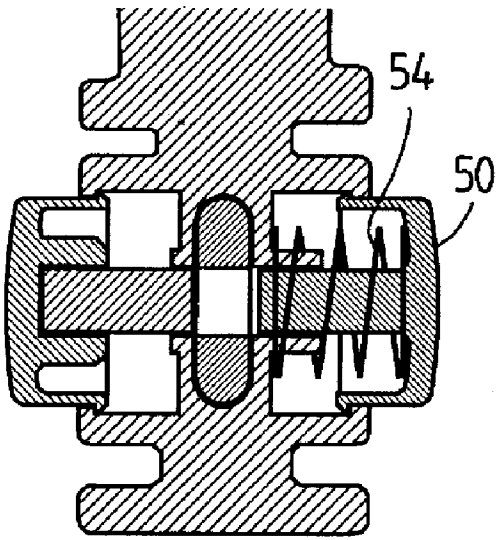
FIG. 8 is a view similar to FIG. 5A where the slide bar has returned to its unlocked position in FIG. 5 by releasing the second push button.
Figure 7:
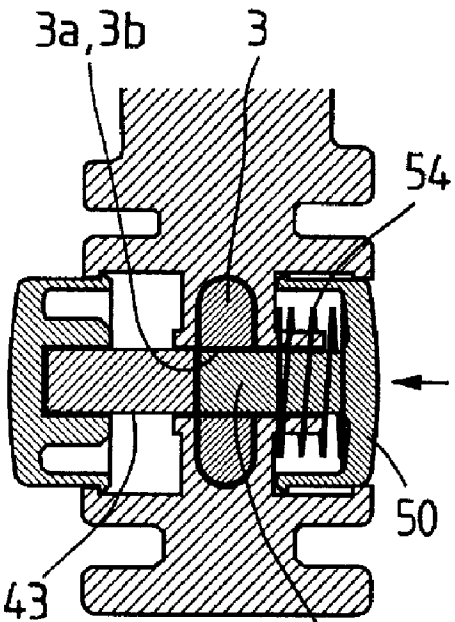
FIG. 7 is a view similar to FIG. 5A where the slide bar is still locked by pressing the second push button toward the fixed jaw carrier to insert a pin of the second push button into the first or second positioning hole with the pin of the first push button being pushed out of the first or second positioning hole.
Figure 6:
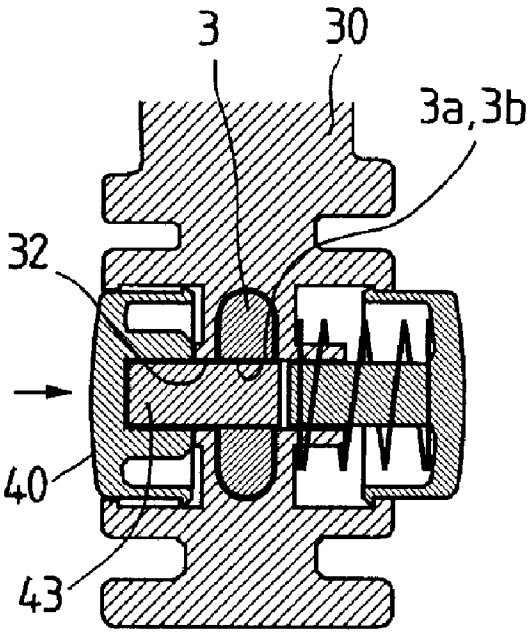
FIG. 6 is a view similar to FIG. 5A where the slide bar is locked by pressing the first push button toward the fixed jaw carrier to insert a pin of the first push button into the first or second positioning hole.

Referring to FIGS. 6, 7, and 8 in conjunction with FIGS. 4, 5, and 5A, fastening and unfastening operations of the invention will be described in detailed below. The slide bar 3 is locked by pressing the first push button 40 toward the fixed jaw carrier 30 to insert the pin 43 into the first positioning hole 3*a* or the second positioning hole 3*b* (see FIG. 6). It is seen that the first push button 40 is completely disposed in the first space 33.

The slide bar 3 is still locked when the second push button 50 is pressed toward the fixed jaw carrier 30 to insert the pin 53 into the first positioning hole 3*a* or the second positioning hole 3*b* by pushing the pin 43 out of the first positioning hole 3*a* or the second positioning hole 3*b* (see FIG. 7). It is seen that the second push button 50 is completely disposed in the second space 34 with the spring 54 being compressed.

Releasing the second push button 50 will cause the compressed spring 54 to expand to push the second push button 50 outwardly until the curved members 51 are stopped by the rim 341 and the pin 53 clears the first positioning hole 3*a* or the second positioning hole 3*b* (see FIG. 8). It is seen that the slide bar 3 has returned to its unlocked position.

While the invention herein disclosed has been described by means of specific embodiments, numerous modifications and variations could be made thereto by those skilled in the art without departing from the scope and spirit of the invention set forth in the claims.

What is claimed is:

1. A vise comprising a slide bar having a positioning hole proximate either end, a movable jaw carrier slidably put on the slide bar, and a fixed jaw carrier including a longitudinal first hole with the slide bar being slidably disposed therethrough, a raised transverse second hole having a boss at either side and being in communication with the first hole, an annular first flange projecting from one side and being concentric with the second hole to define a first space therebetween, the first flange having an inwardly extending first rim at an open end, and an annular second flange projecting from the other side and being concentric with the second hole to define a second space therebetween, the second flange having an inwardly extending second rim at an open end, and a fastening mechanism comprising:

a first push button comprising a cylindrical head, a plurality of spaced outwardly extending curved first members around an inner end, a cylindrical first pin extending from a center of the first push button into the second hole to be adapted to slide therein, and a resilient member put on the first pin and one boss of the second hole and anchored between the first push button and a bottom of the first space wherein the first push button is slidably secured onto an opening of the first space by frictionally engaging the first members with the first rim; and a second push button comprising a cylindrical head, a plurality of spaced outwardly extending curved second members around an inner end, and a cylindrical second pin extending from a center of the second push button into the second hole to be adapted to slide therein wherein the second push button is slidably secured onto an opening of the second space by frictionally engaging the second members with the second rim, wherein the first and the second pins clear one positioning hole when the slide bar is unlocked such that aligning the second hole with one positioning hole, pressing the second push button to insert the second pin into one positioning hole will lock the slide bar; pressing the first push button to insert the first pin into one positioning hole by pushing the second pin out of one positioning hole until the second members are stopped by the second rim with the resilient member being compressed; and releasing the first push button will cause the resilient member to expand to push the first push button outwardly until the first members are stopped by the first rim and the first pin clears one positioning hole.

2. The vise of claim 1, wherein the resilient member is a helical spring.

* * * * *